US006105801A

United States Patent [19]

Minnette

[11] Patent Number: 6,105,801

[45] Date of Patent: Aug. 22, 2000

[54] CONTAINER HAVING COLLAPSIBLE NECK FINISH

[75] Inventor: Jeffrey C. Minnette, Evansville, Ind.

[73] Assignee: Rexam Medical Packaging, Inc., Evansville, Ind.

[21] Appl. No.: 09/366,916

[22] Filed: Aug. 4, 1999

Related U.S. Application Data

[60] Provisional application No. 60/095,307, Aug. 4, 1998.

[51] Int. Cl.[7] ..... B65B 7/28; B65D 41/00

[52] U.S. Cl. ..... 215/44; 215/45; 215/216; 215/330; 215/331

[58] Field of Search ..... 215/43, 44, 45, 215/209, 216, 330, 331

[56] References Cited

U.S. PATENT DOCUMENTS

| | | | |
|---|---|---|---|
| 2,852,054 | 9/1958 | Motley . | |
| 3,204,799 | 9/1965 | Hunter et al. . | |
| 3,716,161 | 2/1973 | Julian et al. . | |
| 3,784,038 | 1/1974 | Uhlig . | |
| 3,817,418 | 6/1974 | Mastrovito . | |
| 4,106,654 | 8/1978 | Jones . | |
| 4,153,172 | 5/1979 | Bialobrzeski . | |
| 4,496,066 | 1/1985 | Bullock, III . | |
| 4,498,597 | 2/1985 | Bashour . | |
| 4,823,967 | 4/1989 | Thompson . | |
| 5,165,559 | 11/1992 | Kusz . | |
| 5,188,249 | 2/1993 | Cargile . | |
| 5,213,225 | 5/1993 | King et al. | 215/330 |
| 5,373,955 | 12/1994 | Marino | 215/256 |
| 5,533,823 | 7/1996 | Pierpont et al. . | |
| 5,551,582 | 9/1996 | Robinson | 215/216 |
| 5,687,865 | 11/1997 | Adams et al. . | |
| 5,836,466 | 11/1998 | Briere et al. | 215/216 |
| 5,860,546 | 1/1999 | Carrier | 215/354 |
| 5,865,330 | 2/1999 | Buono | 215/216 |
| 5,887,737 | 3/1999 | Montgomery | 215/216 |
| 5,964,362 | 10/1999 | Sandor et al. | 215/43 |

*Primary Examiner*—Stephen K. Cronin
*Attorney, Agent, or Firm*—Middleton & Reutlinger; David J. Clement; John F. Salazar

[57] ABSTRACT

The present invention is directed towards a closure and container combination wherein the container has a collapsible neck finish. The collapsible neck finish consists of an upwardly extending neck having outwardly extending threads thereon and located above the threads is a spring bead, the spring bead having an outwardly bulged portion and an inwardly bulged portion. The closure for the combination has a retaining bead formed just below the top wall, the area in between receiving the spring bead of the container. The container and closure combination have interlocking structures comprised of locking lug and stop member on the container neck forming a recess therebetween which receives a locking tab on the lower periphery of the side wall of the closure. The interlocking structure is so formed that when the locking tab is located between the locking lug and stop member, the spring bead is firmly held in place below the top wall of the closure.

20 Claims, 8 Drawing Sheets

CONTAINER HAVING COLLAPSIBLE NECK FINISH

The present application claims priority from provisional application Ser. No. 60/095,307 filed Aug. 4, 1998.

BACKGROUND OF THE INVENTION

1. Technical Field of the Invention

The present invention relates to containers for storing and dispensing liquid contents therefrom. More particularly, the present invention is for a container for storing and dispensing liquid contents therefrom, wherein leakage of the liquid contents from the container is inhibited.

2. Description of the Related Art

It is well-known in the prior art to provide a container for storing and dispensing liquid contents therefrom. Containers typical of those found in the prior art include a bottle and a cap, wherein the bottle is provided with a neck portion having a dispensing opening therein, and wherein the cap is engageable with the bottle neck portion to prevent spillage of the liquid contents therefrom. However, leakage may nevertheless occur where the cap is not sealingly engaged on the bottle neck portion at all locations.

For example, the cap and the bottle neck portion may be provided with engaging threads by which an open, upper annular end of the bottle neck portion is brought into tight abutting relationship with an underside sealing surface of the cap. However, the molding process by which both the cap and the bottle are typically formed oftentimes results in large tolerances between the dimensions of their respective mating parts. Thus, leakage oftentimes occurs notwithstanding the desired sealing engagement between the cap and the bottle neck portion.

A flexible gasket or liner is oftentimes adhered to the underside surface of the cap, which is positioned to sealingly engage the upper annular end of the bottle neck portion. The flexible gasket closely conforms to minor variations in the dimensional tolerances of the upper annular end of the bottle neck portion, thereby providing a liquid-impervious seal therebetween. However, repeated over-tightening of the cap on the bottle neck portion oftentimes results in plastic deformation of the sealing gasket, thereby inhibiting the sealing gasket to closely conform to variations in the dimensional tolerances of the upper annular end of the bottle neck portion. Thus, leakage oftentimes occurs notwithstanding the desired sealing engagement between the cap sealing gasket and the bottle neck portion.

It is therefore desirable to provide a container for storing and dispensing liquid contents therefrom, wherein leakage of the liquid contents from the container is inhibited.

BRIEF DESCRIPTION OF THE DRAWINGS

A better understanding of the present invention will be had upon reference to the following description in conjunction with the accompanying drawings in which like numerals refer to like parts, and wherein.

DETAILED DESCRIPTION OF THE PREFERRED EMBODIMENTS

Figure 1:
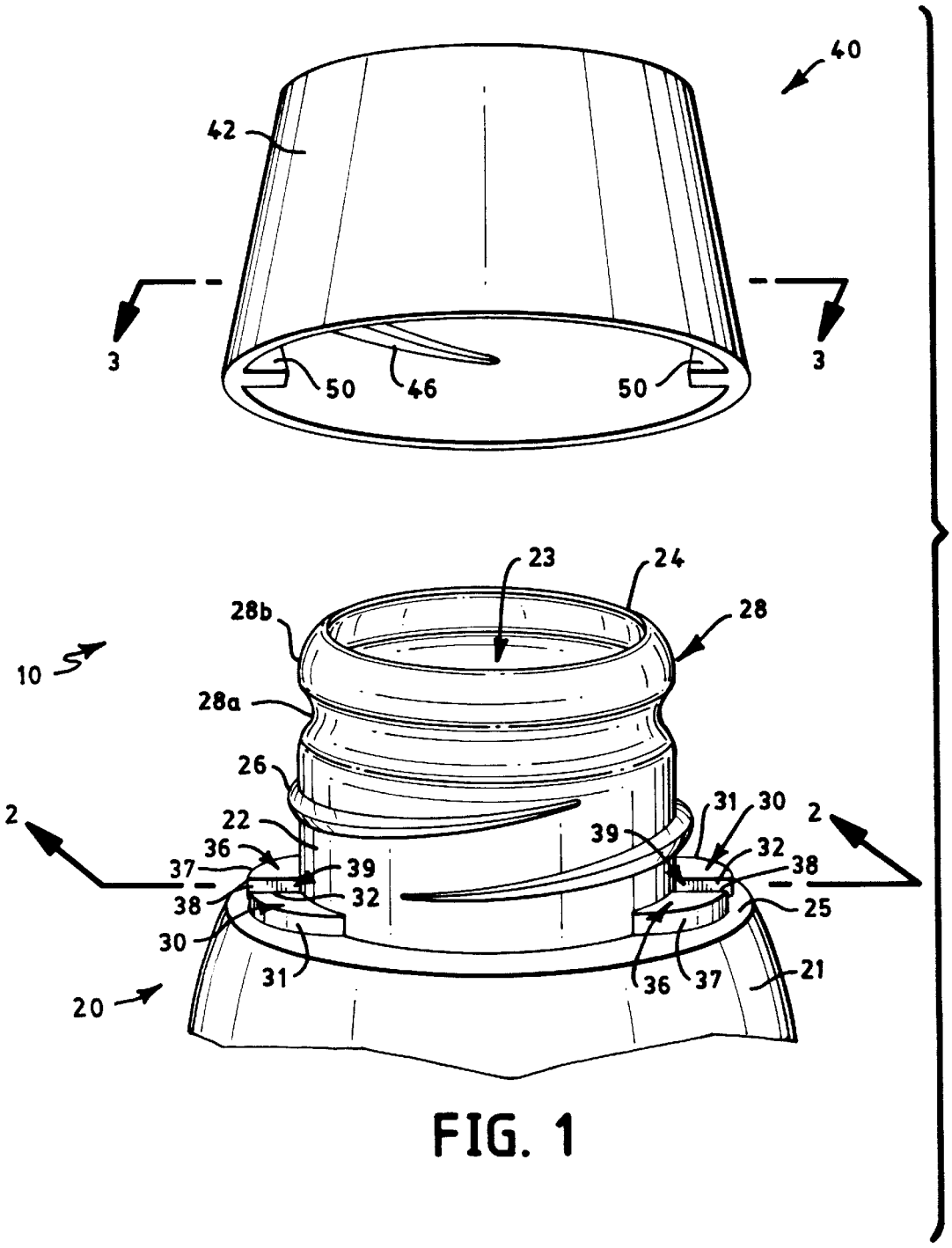
FIG. 1 is a perspective view of a container according to a preferred embodiment of the present invention, wherein a cap portion of the container is shown in spaced relation to a bottle neck portion of the container.

With reference to FIG. 1, a container 10 according to a preferred embodiment of the present invention includes a bottle 20 (having only a neck portion 22 thereof being shown in the Figures) and a cap 40 threadingly affixed to the bottle neck portion 22 to cover an open upper end 24 thereof. The bottle 20 and the cap 40 are preferably constructed from a thermal-forming polymer, such as polyethylene or polypropylene, and are preferably formed by an injection molding process.

Figure 2:
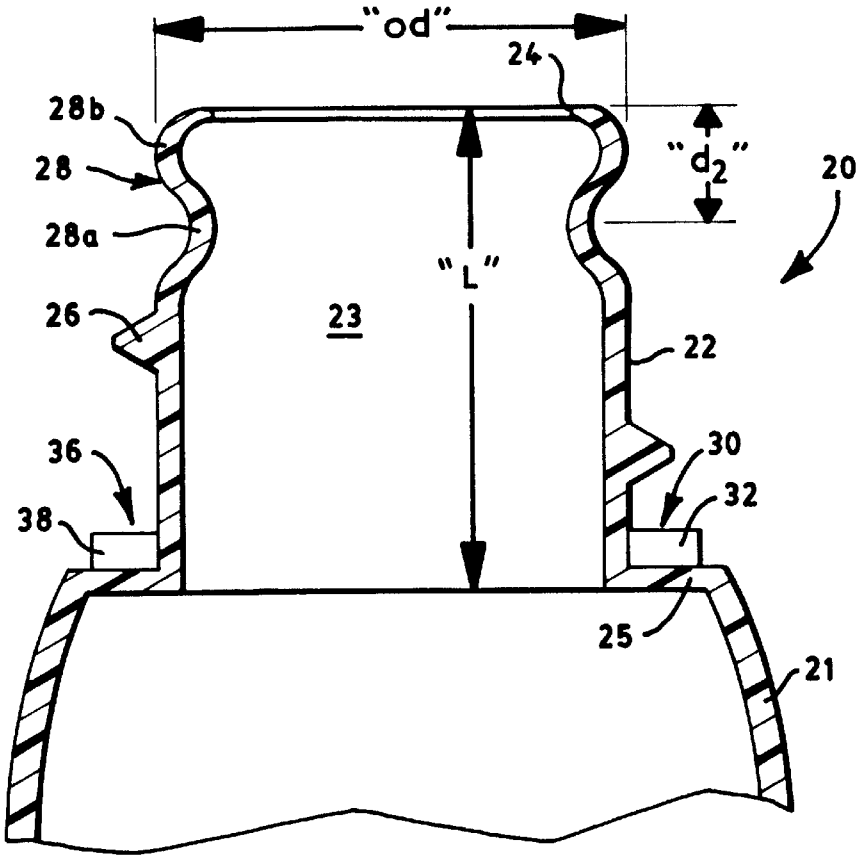
FIG. 2 is a section view of the bottle neck portion of the container of FIG. 1, shown taken along section line 2—2 of FIG. 1.

With additional reference to FIG. 2, the bottle 20 includes a body portion 21 defining a cavity therein for receiving and storing contents, and preferably for receiving and storing liquid contents therein. The cavity communicates with the open upper end 24 by a passageway 23 through the bottle neck portion 22. The body portion 21 is connected to the neck portion 22 by an annular shoulder 25.

Figure 3:
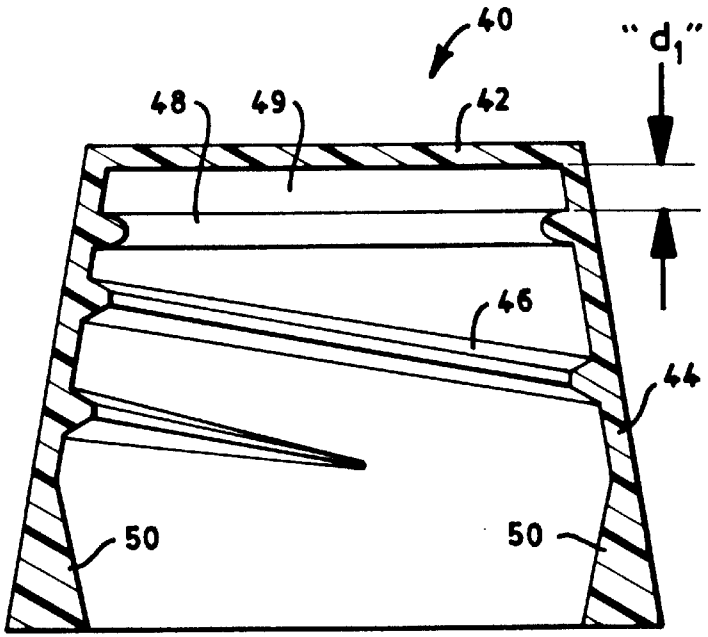
FIG. 3 is a section view of the cap portion of the container of FIG. 1, shown taken along section line 3—3 of FIG. 1.

With additional reference to FIG. 3, the cap 40 includes a top wall 42 and a side wall 44 depending downwardly from an outer perimeter of the top wall 42. The cap 40 is sized to be telescopically received over the bottle neck portion 22 to cover the open upper end 24 thereof. An internal thread 46 is provided on an inner surface of the cap side wall 44 and is sized to threadingly engage an external thread 26 provided on an outer surface of the bottle neck portion 22.

At least one locking lug 30 is integrally-formed with the bottle neck portion 22 towards the shoulder 25 and includes a forwardly-ramped surface 31 and an abutment 32. Preferably, two locking lugs 30 are provided diametrically opposed to one another. A stop tab 36 is integrally-formed with the bottle neck portion 22 towards the shoulder 25, annularly spaced from the locking lug 30 and opposed thereto. The stop tab 36 includes a stop 38 which opposes the abutment 32 of the locking lug 30 and a rearwardly-sloped surface 37 therebehind. The abutment 32 and the stop 38 cooperate to define a tab-receiving recess 39 therebetween.

At least one locking tab 50 is integrally-formed with the cap side wall 44 near a lower end thereof and projects inwardly therefrom. Preferably, two locking tabs 50 are provided diametrically opposed to one another. The locking tab 50 preferably projects radially inwardly towards the central axis of the bottle neck portion 22, although the locking tab 50 may alternatively project inwardly at an angle relative thereto.

The locking tab 50 is sized to be received by the tab-receiving recess 39 between opposing surfaces of the locking lug 30 and the stop tab 36 of the bottle neck portion 22, respectively. More particularly, as the cap 40 is threadingly affixed downwardly on the bottle neck portion 22, the locking tab 50 rides over the forwardly-ramped surface 31 of the locking lug 30, thereby deforming the cap side wall 44 outwardly, until the locking tab 50 is positioned radially outwardly from the tab-receiving recess 39, at which point the resiliency of the cap side wall 44 snaps the locking tab 50 into the tab-receiving recess 39. Rotation of the cap 40 in either a forward direction or a reverse direction is prevented by the stop 38 and the abutment 32, respectively. Thus, the cap 40 is positioned in substantially the same angular position relative to the bottle neck portion 22 every time the cap 40 is fully affixed to the bottle 20.

The bottle neck portion 22 further includes a spring bead 28 near the upper end 24 thereof, and preferably between the upper end 24 and the external thread 26. The spring bead 28 is substantially "S"-shaped and includes an inwardly-bulged portion 28*a* and an outwardly-bulged portion 28*b*. As is described in greater detail below, the spring bead 28 is compressible along the central axis of the bottle neck portion 22, thereby permitting minor changes in the distance "L" between the open upper end 24 of the bottle neck portion 22 and the shoulder 25.

A continuous retaining bead 48 projects inwardly from the cap side wall 44 near the top wall 42 and forms a spring bead-receiving pocket 49 therebetween. The retaining bead 48 is spaced downwardly from the top wall 42 a distance "$d_1$" which is less than a distance "$d_2$"between a central region of the inwardly-bulged portion 28*a* of the spring bead 28 and the open upper end 24 of the bottle neck portion 22. A sealing gasket or liner (not shown) may be positioned within the spring bead-receiving pocket 49 and affixed to an underside surface of the top wall 42, for example, by an adhesive or by a retaining element (not shown) integrally-formed with and projecting downwardly from the top wall 42.

Figure 4:
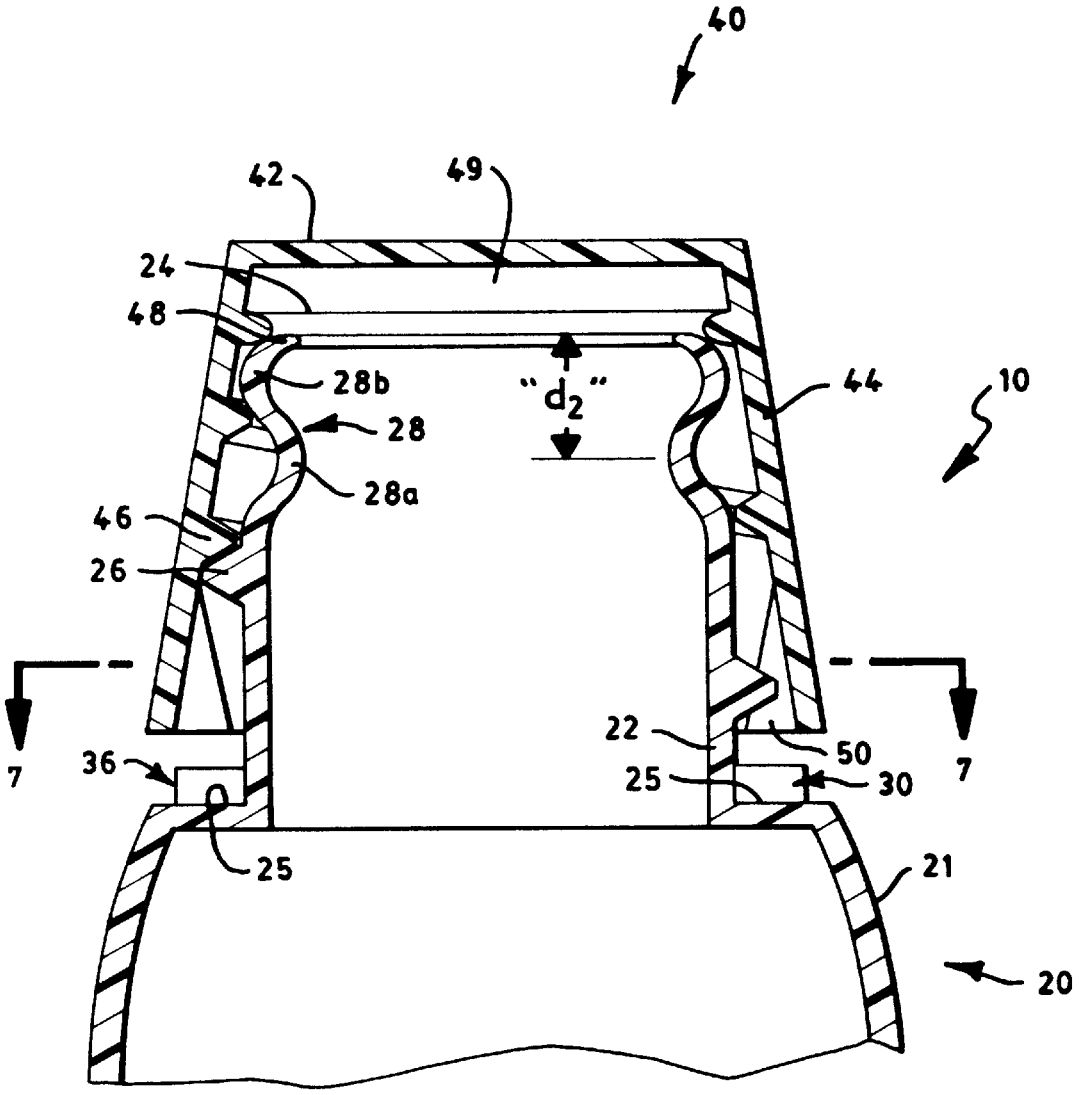
FIG. 4 is a section view of the bottle neck portion of the container of FIG. 2, wherein the cap portion of the container of FIG. 1 is shown in engaged relation thereto prior to engagement of a bottle neck spring bead with a cap retaining bead.
Figure 5:
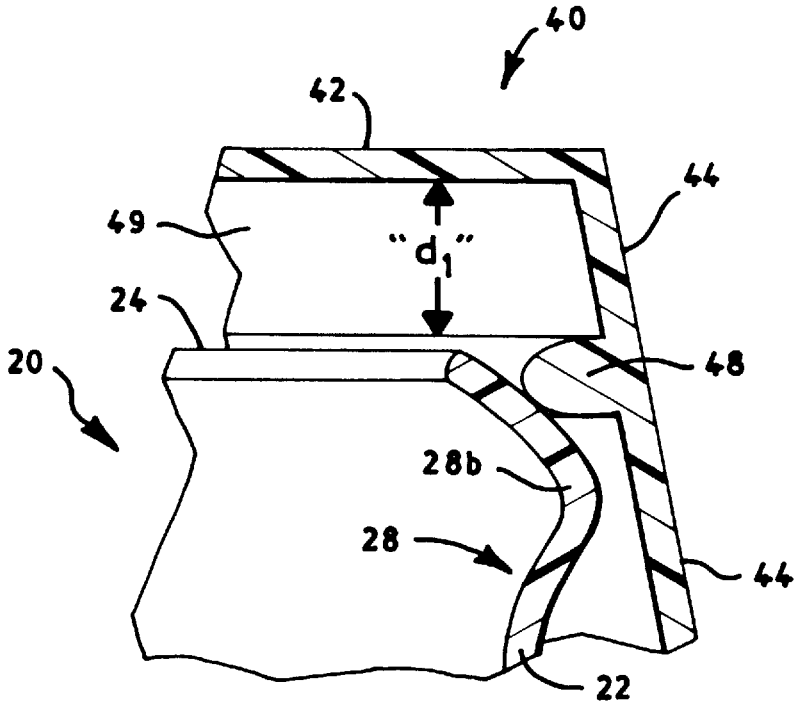
FIG. 5 is a detail section view of the bottle neck portion of the container of FIG. 2, wherein the cap portion of the container of FIG. 1 is shown in engaged relation thereto prior to engagement of a bottle neck spring bead with a cap retaining bead.

With addition reference to FIGS. 4 and 5, the cap 40 is threadingly affixed to the bottle neck portion 22 until the outwardly-bulged portion 28*b* of the cap spring bead 28 contacts the bottle neck portion retaining bead 48, at which point the locking tab 50 is offset from a radial centerline of the tab-receiving recess 39 by more than about 105° , and preferably by more than about 120°.

Figure 6:
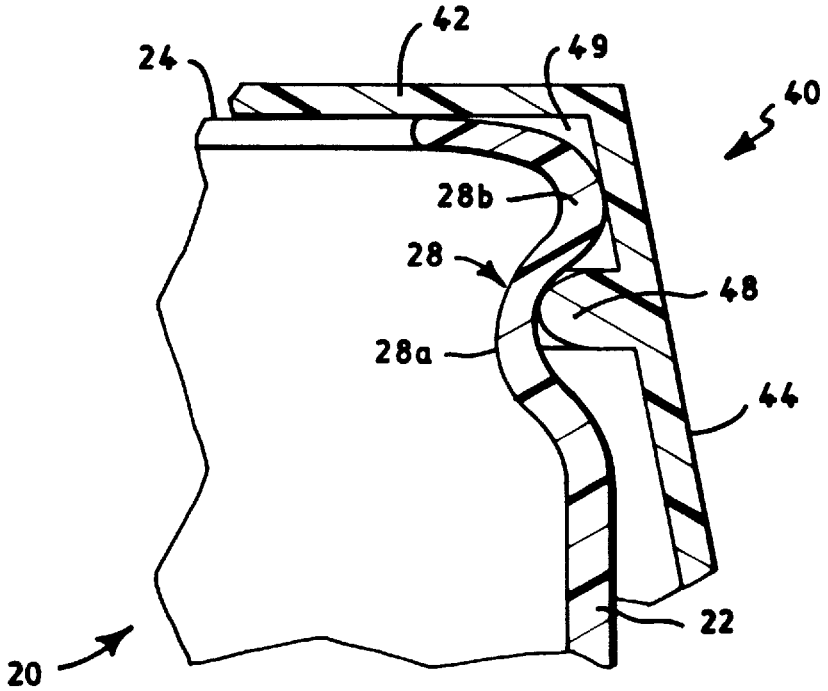
FIG. 6 is a detail section view of the bottle neck portion of the container of FIG. 2, wherein the cap portion of the container of FIG. 1 is shown in engaged relation thereto.
Figure 7:
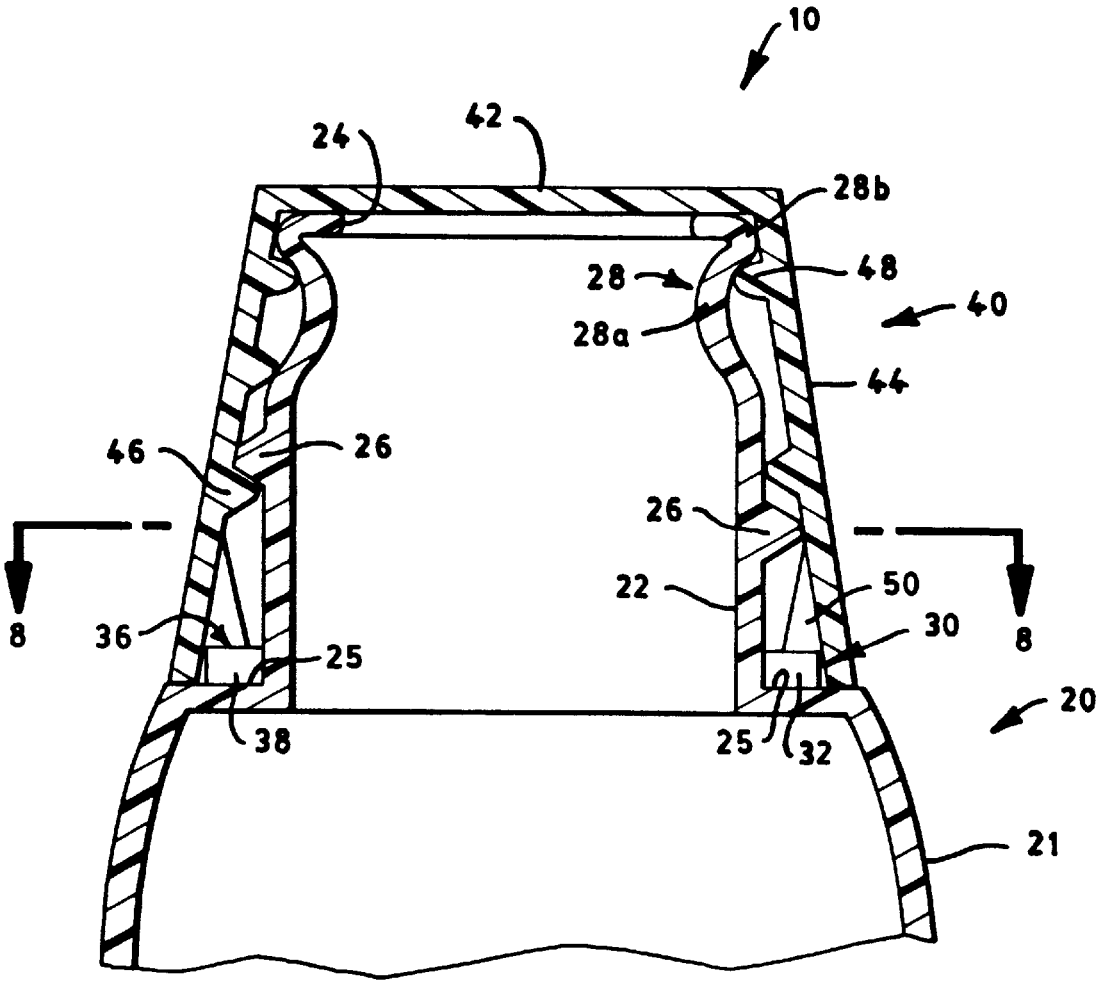
FIG. 7 is a section view of the bottle neck portion of the container of FIG. 4, wherein the cap portion of the container of FIG. 1 is shown in engaged relation thereto immediately prior to engagement of the bottle neck spring bead with the cap retaining bead.
Figure 8:
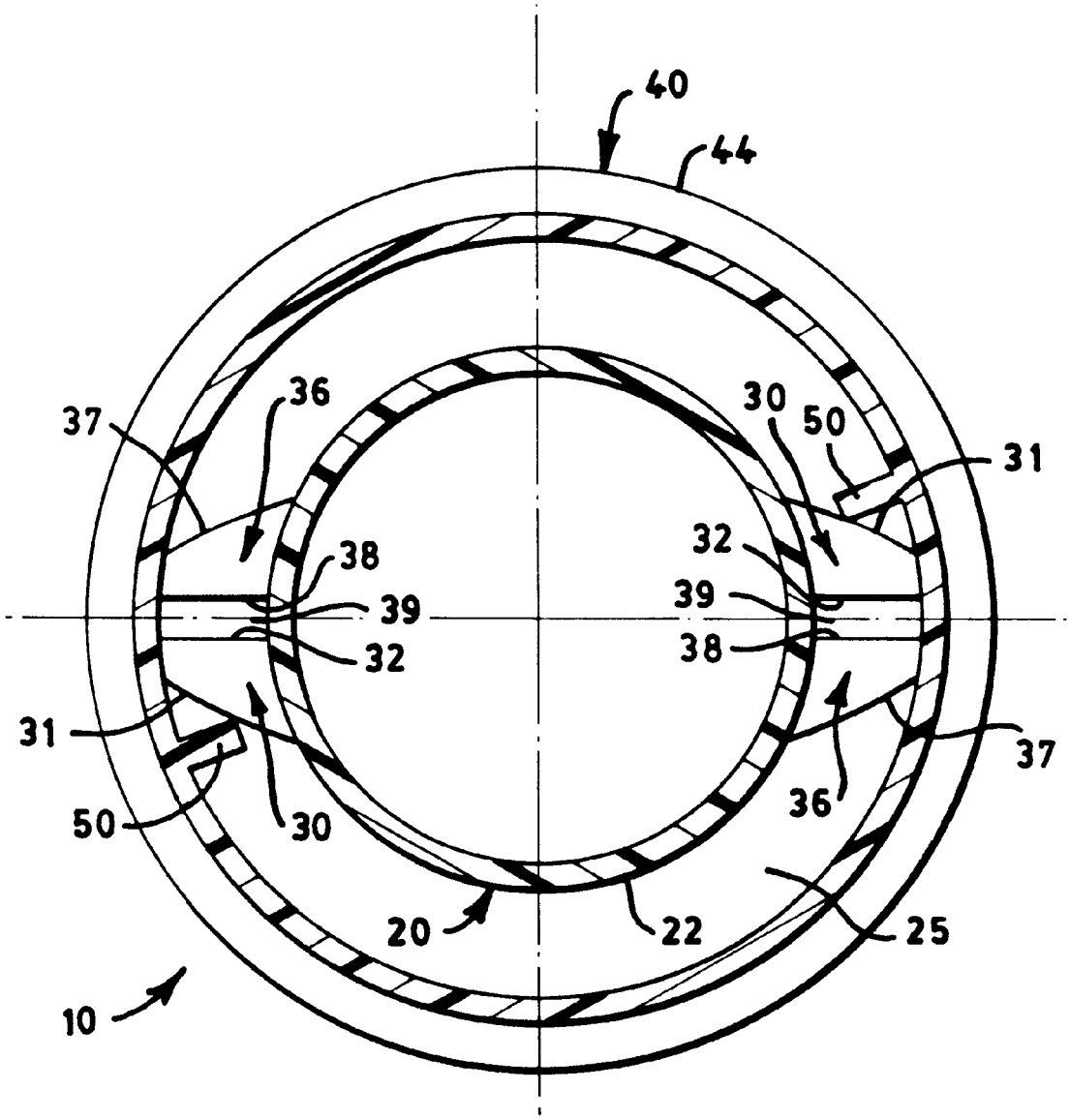
FIG. 8 is a section view of the bottle neck portion of the container of FIG. 7, shown taken along section line 8—8 of FIG. 7, wherein the cap portion of the container of FIG. 7 is shown in engaged relation thereto immediately prior to engagement of the bottle neck spring bead with the cap retaining bead.
Figure 9:
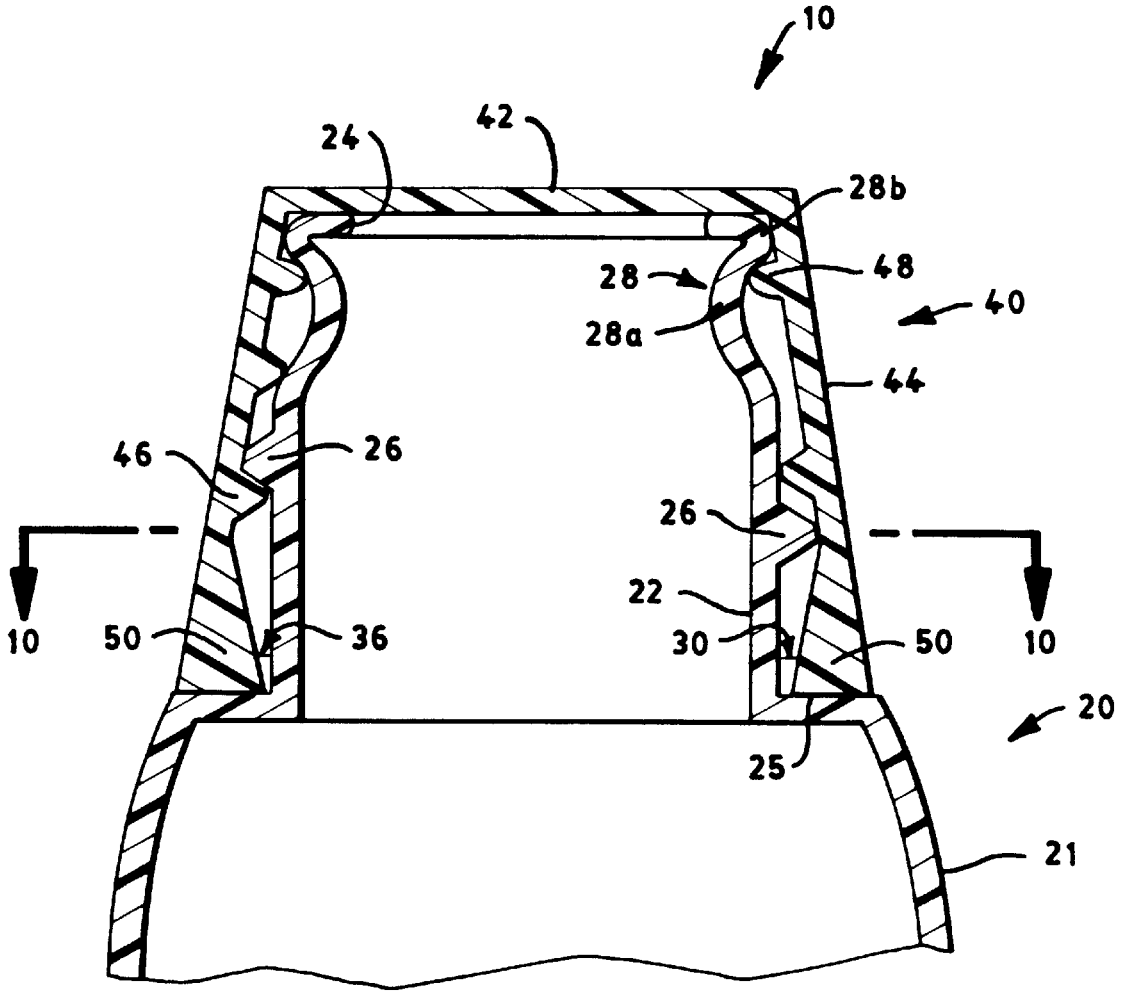
FIG. 9 is a section view of the bottle neck portion of the container of FIG. 4, wherein the cap portion of the container of FIG. 1 is shown in engaged relation thereto upon engagement of the bottle neck spring bead with the cap retaining bead; and, FIG. 10 is a section view of the bottle neck portion of the container of FIG. 9, shown taken along section line 10—10 of FIG. 9, wherein the cap portion of the container of FIG. 9 is shown in engaged relation thereto upon engagement of the bottle neck spring bead with the cap retaining bead.

With additional reference to FIGS. 6, 7, and 9, additional forward rotation of the cap 40 on the bottle neck portion 20 causes the spring bead 28 to snap upwardly over the retaining bead 48 and to contact the underside surface of the cap top wall 42, at which point the locking tab 50 is annularly offset from the radial centerline of the tab-receiving recess 39 by about 105°, and preferably by about 120°. Because distance "$d_1$" is less than distance "$d_2$", the outwardly-bulged portion 28*b* of the spring bead 28 is squeezed between the underside surface of the cap top wall 42 and the bottle neck portion retaining bead 48, thereby providing an upward biasing force of the bottle neck portion open upper end 24 against the underside surface of the cap top wall 42, thereby forming a sealing fit therebetween. Where a sealing gasket or liner is provided, the open upper end 24 of the bottle neck portion 22 is received thereby, forming a tight liquid-impervious seal therebetween. Further, the outer diameter "od" of the outwardly-bulging portion 28*b* of the spring bead 28 will increase as the outwardly-bulging portion 28*b* is squeezed between the underside surface of the cap top wall 42 and the bottle neck portion retaining bead 48, thereby providing a secondary seal between the outwardly-bulged portion 28*b* and the inner surface of the cap side wall 44.

Figure 10:
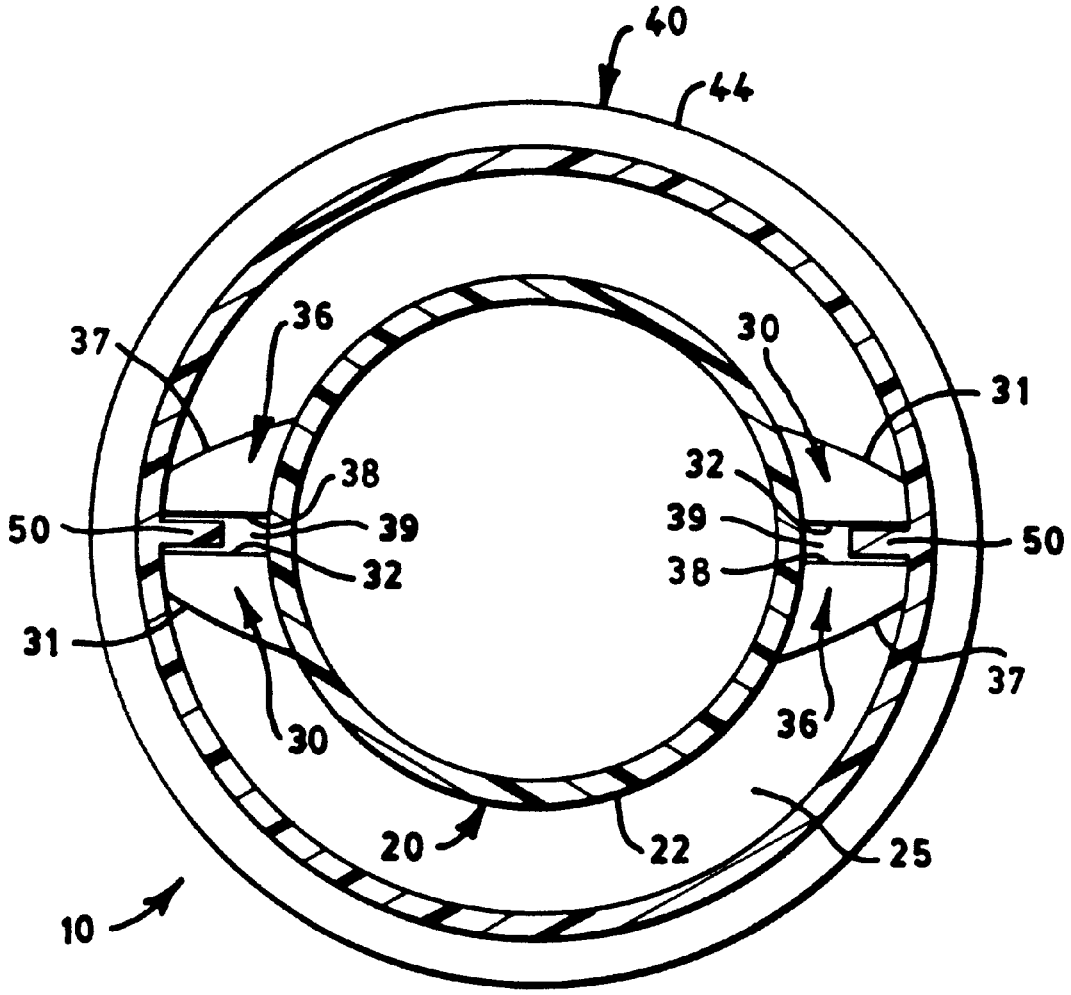

With additional reference to FIGS. 9 and 10, as the cap 40 is further rotated forwardly on the bottle neck portion 22, the spring bead 28 is further compressed against the underside surface of the cap top wall 42, thereby providing a greater biasing force to increase the sealing fit therebetween. Forward rotation of the cap 40 continues until the locking tab 50 passes over the locking lug forwardly-ramped surface 31 and is seated within the tab-receiving recess 39. Rotation of the cap 40 such that the locking tab 50 is positioned beyond the stop tab 36 would cause the biasing force to unaidedly rotate the cap 40 in a reverse direction until the locking tab 50 passed over the rearwardly-sloped surface 38 and into the tab-receiving recess 39.

What is claimed is:

1. A container having a collapsible neck finish, comprising:

a container having a body portion, an upwardly extending neck portion and a shoulder portion therebetween, said upwardly extending neck portion extending to an upper end thereof;

at least one external thread on said neck portion;

a spring bead below said upper end of said neck portion, said spring bead having an outwardly bulged portion and an inwardly bulged portion.

2. The container of claim 1 wherein said inwardly bulged portion is directly below said outwardly bulged portion, both of said inwardly and outwardly bulged portions above said at least one external thread.

3. The container of claim 1 further comprising:

a closure, said closure having a top wall and a depending side wall;

at least one internal thread threadably engaging said at least one external thread of said container;

a continuous retaining bead below said top wall and extending inwardly from said side wall, said continuous retaining bead forming a spring bead receiving pocket between said continuous retaining bead and said top wall.

4. The container of claim 3 wherein said closure is further comprised of at least one locking tab inwardly directed from said depending side wall and located along the bottom periphery thereof.

5. The container of claim 4 wherein said locking tab is generally triangular in shape.

6. The container of claim 1 further comprising at least one locking lug and at least one stop tab.

7. The container of claim 6 wherein said at least one locking lug and said at least one stop tab form a tab receiving recess therebetween.

8. The container of claim 6 wherein said locking lug has a ramp surface, said ramped surface ramped in the clockwise direction towards said stop tab.

9. The container of claim 6 wherein said stop tab is further comprised of an abutment surface opposite said locking lug.

10. The container of claim 6 further comprising a second locking lug and a second stop tab located at a 180 degree interval from said first locking lug and said first stop tab.

11. A closure and container having a collapsible neck finish, comprising:

a container having a body portion, an upwardly extending neck portion and a shoulder portion therebetween, said upwardly extending neck portion extending to an upper end thereof;

at least one external thread on said neck portion;

a spring bead below said upper end of said neck portion, said spring bead having an outwardly bulged portion and an inwardly bulged portion;

a closure having a top wall, a depending side wall and an inwardly directed thread, said closure threadably engaging said container through said external thread on said neck portion.

12. The closure and container of claim 11 wherein said closure is further comprised of an inwardly directed retaining bead, said retaining bead forming a spring bead receiving pocket between said retaining bead and said top wall.

13. The closure and container of claim 12 wherein said spring bead is received within said spring bead receiving pocket.

14. The closure and container of claim 13 further comprising:

at least one locking lug and at least one stop tab formed on the shoulder of said container, said stop tab and said locking lug forming a tab receiving recess therebetween;

at least one locking tab inwardly directed from said depending side wall and located along the bottom periphery thereof.

15. The closure and container of claim 14 whereby when said spring bead is located within said spring bead receiving pocket, said locking tab of said closure is located within said tab receiving recess of said container.

16. The closure and container of claim 15 further comprising a second locking tab formed 180 degrees from said first locking tab.

17. The closure and container of claim 16 further comprising a second stop tab and a second locking lug formed 180 degrees from said first stop tab and said first locking lug.

18. A closure and container combination, comprising:

a container having a body portion and an upwardly extending neck portion;

at least one external thread on said neck portion;

a spring bead formed above said at least one thread;

a closure having a top wall, a depending side wall, an inwardly directed thread and a inwardly directed retaining bead, said retaining bead forming a spring bead receiving pocket between said retaining bead and said top wall;

at least one locking lug formed below said neck of said container;

at least one locking tab inwardly directed from said depending side wall.

19. The closure and container of claim 18 further comprising at least one stop tab adjacent said locking lug in the clockwise direction, said stop tab and locking lug forming a tab receiving recess therebetween such that when said spring bead is located in said spring bead receiving pocket of said closure, said locking tab is located within said tab receiving recess of said container.

20. The closure and container of claim 18 wherein said spring bead is further comprised of an outwardly bulged portion and an inwardly bulged portion, said outwardly bulged portion directly above said inwardly bulged portion.

* * * * *